US005865328A

United States Patent [19]

Kaspar

[11] Patent Number: 5,865,328

[45] Date of Patent: Feb. 2, 1999

[54] TELESCOPIC BOOM

[75] Inventor: Ernst Kaspar, Munderkingen, Germany

[73] Assignee: EC Engineering + Consulting Spezialmaschinen GmbH, Ulm, Germany

[21] Appl. No.: 934,350

[22] Filed: Sep. 19, 1997

Related U.S. Application Data

[63] Continuation of Ser. No. 564,105, filed as PCT/EP94/01965, Jun. 16, 1994, abandoned.

[30] Foreign Application Priority Data

Jun. 16, 1993 [DE] Germany ..... 93 08 993 U

[51] Int. Cl.[6] ..... B66C 23/697

[52] U.S. Cl. ..... 212/350; 212/230; 212/348

[58] Field of Search ..... 52/118; 212/230, 212/231, 347, 348, 349, 350

[56] References Cited

U.S. PATENT DOCUMENTS

| | | | |
|---|---|---|---|
| 3,481,490 | 12/1969 | Eiler | 212/350 |
| 3,796,016 | 3/1974 | Wu | 414/496 |
| 4,148,531 | 4/1979 | Hornagold | 212/349 |
| 4,276,210 | 6/1981 | Landolt et al. | 212/350 |
| 4,357,785 | 11/1982 | Eklund | 212/350 |
| 4,478,014 | 10/1984 | Poock et al | 212/350 |
| 5,158,189 | 10/1992 | Watson et al. | 212/350 |

FOREIGN PATENT DOCUMENTS

| | | | |
|---|---|---|---|
| 2302644 | 11/1974 | Germany | 212/350 |
| 3042993 | 7/1982 | Germany | 212/350 |
| 3101017 | 8/1982 | Germany | 212/350 |

*Primary Examiner*—Thomas J. Brahan
*Attorney, Agent, or Firm*—Seed and Berry LLP

[57] ABSTRACT

The present invention relates to a telescopic boom with at least one outer structure and at least one inner structure, each of which is designed as a hollow section with upper flange and lower flange, the upper flange having a half-basket profile with two rounded edges to which the lower flange is joined with a liner of an essentially U-shaped profile, and each structure being mounted on the adjoining structure with a front and a back bearing. To achieve a stable bearing of the structures and a great usable extension length with this boom under high force level, the invention proposes that the front bearing has a slide element in the area between the lower flanges only in the region of the curvature, and the back bearing has a separate plain bearing half liner in the area between the upper flanges only in the region of each rounded edge.

23 Claims, 5 Drawing Sheets

A–A

B–B

TELESCOPIC BOOM

REFERENCE TO RELATED APPLICATION

This application is a continuation of U.S. patent application Ser. No. 08/564,105, filed as PCT/EP94/01965 Jun. 16, 1994, now abandoned.

TECHNICAL FIELD

The present invention relates to a telescopic boom comprising at least one outer structure and at least one inner structure, each of which is designed as a hollow section with an upper flange connected to a lower flange. The upper flange has a half-basket profile with a web portion extending between two rounded edge portions (also referred to herein as rounded corner portions) and opposing side portions connected to and extending away from the edge portions. The lower flange has an essentially U-shaped profile and is connected to the side portions of the upper flange. Each outer and inner structure is mounted on an adjoining outer or inner structure with a front and rear bearing assembly.

BACKGROUND OF THE INVENTION

Booms of this type are known from practice, for instance from mobile cranes. A load is hung on the front end of an extended inner structure so that the inner structure with its lower flange exerts a load on the front end section of the lower flange of the outer structure. At the same time, the rear end of the inner structure exerts a load on the upper flange of the outer structure with its upper flange. Within the scope of this invention, "front" designates the direction towards the load-receiving free end of the boom, and "rear" designates the direction towards the end opposite to the free boom end.

On account of the great forces to be transmitted, special attention has to be paid to the design of the front and rear bearings connected to the inner and outer structures. Apart from a reliable support, these bearings are also designed to counteract undesired deformations of the profile cross-sections of the inner and outer structures. Normally, full support of slide elements of the front and rear bearings is therefore sought to be achieved. The slide elements are each fixed on one side to a laterally bordered plane bearing block on one of the inner or outer structures and the slide elements are each supported on the adjoining outer or inner structure at the opposite side of the respective slide element. Reinforcing support means in the form of collars are required for receiving the forces acting on the slide elements and the bearing blocks. As a rule, the collars on the inner structures for the rear bearings are made continuous over the cross-sectional shape of the inner structure and jointly form an enclosure for the slide elements, whilst the collars of the front bearings are normally mounted externally on the outer structure and consist of solid material with a dimension of 150 to 300 mm in the longitudinal direction of the boom. The collars thereby reduce the usable extension length of the structure in question. As shown in FIG. 6 (prior art), the inner structures cannot be fully telescoped into one another, as they are hindered from doing so by the inner collars. The same happens analogously in the region of the front bearing with the outer collars.

DE-OS 1531174 suggests a roller bearing for telescopic booms with a polygonal cross-section. To receive the edge stresses occurring upon load, each edge of the lower flange has assigned thereto an outer roll, and each edge of the upper flange an inner roll. The outer and inner rolls present obstacles to one another in a disadvantageous manner, whenever the structures are slid into one another, so that the usable extension length of the structures is reduced at least by the sum of the diameter of the rolls arranged side by side. Moreover, the inner rolls occupy a lot of space in the hollow profile cross-section of the inner structure, so that there is only little space for the telescopic cylinder unit arranged therein for extending the boom.

SUMMARY OF THE INVENTION

It is the object of the present invention to provide a telescopic boom of the type outlined at the outset, which boom is able to receive a high force level and which is distinguished by a stable bearing of the structures and a great usable extension length.

This object is achieved according to the invention in that the front bearing assembly has a slide member, also referred to as a slide element, in the area between the lower flanges only in a region of curvature of the lower flanges, and a rear bearing assembly has a separate slide member, referred to as a "plain bearing half liner" in an area between the upper flanges only in a region of each rounded edge or corner portion of the upper flanges.

On account of such a support provided by the present invention, the forces between two adjacent outer and inner structures are only transmitted via rounded portions of the outer and inner structures that are substantially stiffer than the straight surface of the bearings. This prevents bulging of the surfaces and deformation of the profile cross-section of the outer and inner structures. The function of the collar can substantially be limited to the measure of preventing the structure from expanding at its end. Since the collar need no longer receive the support forces to the full extent, it can be made substantially shorter in the longitudinal direction of the structures. In practice, the collar can be reduced to a length of about 50 mm. This means that the individual structures, as shown in FIG. 5, can be moved into one another to a substantially greater degree, so that a larger usable extension length of the telescopic boom is available.

On the other hand, the slide element and the plain bearing half liners of the front and rear bearing assemblies, respectively, may be made considerably thinner. Whilst in the prior art thicknesses of 40 to 50 mm are still required, the thickness in the inventive solution can be reduced to less than 20 mm. This means that in an outer structure there is more space for additional inner structures which increase the usable extension length. With the support provided by the present invention, it is possible to slide seven structures into one another without any problem, and the cross-section of the outermost structure does not exceed the outer cross-section of conventional telescopic booms. With the supports according to the prior art, it has so far only been possible to slide a maximum of five structures into one another.

Moreover, the tolerances of the slide element and the plain bearing half liners of the front and rear bearing assemblies, respectively, can quite accurately be adapted to the rounded corner portions in the upper flange and the region of curvature of the lower flange. The front and rear bearing assemblies permit slight deformations of the straight side portions of the structures' cross-sections whilst the rounded corner portions and the regions of curvature in the upper and lower flanges, respectively, provide support of the structures within one another. As a result, additional tolerance compensating elements as have normally been required in the prior art can be dispensed with.

The slide element and the plain bearing half liners of the front and rear bearing assemblies, respectively, are advantageously self-centered at the rounded corner portions of the upper flanges and at the regions of curvature of the lower flanges. As a consequence, the slide elements and the plain bearing half liners need not be fixed in the circumferential direction of their respective cross section.

In an especially advantageous embodiment, the rear bearing in the area between the lower flanges comprises at least one liner-shaped slide element which extends at least partially along each of the regions of curvature, also referred to herein as curved sides of the lower flanges. This arrangement of the slide elements between adjacent lower flanges is especially advantageous for receiving lateral forces which are for instance created when a mobile crane having a telescopic boom of the present invention is turned. The liner-shaped slide elements prevent torsion of the boom cross-section.

The liner-shaped slide element of the rear bearing assembly comprises two separate sliding block elements in the area between the lower flanges, with a respective one of the sliding block elements being arranged along each of the curved sides of the lower flanges which adjoin the upper flanges. Hence, the liner-shaped slide element is divided into the two separate sliding block elements of which each receives the torsional forces. Accordingly, a supporting bearing in the lower U-shaped portion of the lower flange is unnecessary and is not a component of the telescopic boom of the present invention. This facilitates production of the profile cross-section in this area, since exact tolerances need not be indicated.

In an alternate embodiment of the invention, the front bearing assembly, which is also referred to herein as a front bearing, comprises a separate slide member or "plain bearing half liner" in the area between the upper flanges only in the region of each rounded corner portion of the upper flanges. These additional plain bearing half liners between the upper flanges also prevent torsion of the inner and outer structures at the rounded corner portions.

Preferably, the sliding block element and the plain bearing half liners of the rear bearing assembly are fixed to the inner structure.

The slide element(s) and the plain bearing half liners of the front bearing assembly can specifically be fixed to the outer structure.

In a preferred embodiment, the radial distance between inner and outer structures is greater in the area between the rounded corner portions than in the area between the straight portions of the upper flange. As a result, the plain bearing half liners can be made slightly thicker in the area of the rounded corner portions so that they are capable of transmitting greater forces. The remaining space in the straight portions is minimized in a space-saving manner.

Possibly, the center point of the outer rounded corner portion of the outer structure's upper flange and the center point of the inner rounded corner portion of the inner structure's upper flange are arranged in spaced-apart fashion, with the center point of the outer rounded corner portion being arranged closer to the outer rounded corner portion than the center point of the inner rounded corner portion. This increases the space for the plain bearing half liners in the space between the inner and outer rounded corner portions, whereby the distance can be kept small in the adjoining straight portions.

Preferably, the plain bearing half liners between the rounded corner portions and/or the slide elements between the lower flanges extend beyond the curved portions into the straight side portions of the upper flanges, with the plain bearing half liners and the slide elements resting, as the side of the structure moved relative, thereto, only in the curved area on said structure. This limits the support of the plain bearing half liners and the slide elements on the relatively moved structure to the, structure's stable curved portions (e.g., the rounded corner portions in the upper flanges and the regions of curvature in the lower flanges). This prevents jamming of the structures, since the end of the force-introducing-zone (curvature) does not coincide with the end edge of the plain bearing half liner. On the structure to which the slide element is, for instance, fixed, the slide element extends into the straight portions adjacent to the region of curvature, so that the slide element is positioned at the transition of curved and straight portions of the lower flange independently in the circumferential direction of the slide element's profile cross-section.

Advantageously, the plain bearing half liners are fixedly attached to one of the inner and outer structures and the plain bearing half liners have inclined surfaces facing toward the adjacent other one of inner and outer structures to which the plain bearing half liner is not fixedly attached. The inclined surfaces extend away from the rounded corner portion of the upper flange and into the straight side or web portions of the upper flanges. The inclined surfaces are spaced apart from the straight side or web portions of the upper flanges which the respective inclined surface faces and defines an angle $\alpha$ relative to the straight side therebetween, so as to define an inclined starting zone. Similarly, each of the slide element is fixedly attached to the lower flange of one of the inner and outer structures, and the slide element has inclined surfaces facing toward the adjacent other one of the inner and outer structures to which the slide element is not fixedly attached. The inclined surface extends away from the region of curvature of the lower flange to which the slide element is not fixedly attached. The inclined surfaces are spaced apart from the lower flange which the inclined surfaces faces to define an angle $\alpha$ therebetween, so as to define an inclined starting zone. The inclined starting zones prevent the inner and outer structures from getting jammed.

In one embodiment, the outer structure in the area of the front bearing includes a front collar and the inner structure in the area of the rear bearing has a rear collar which serve as an axial abutment of the slide element and plain bearing half liners, respectively. The collars reinforce the structure's profile and prevent an expansion or compression of the structures at their ends, with the slide bodies (e.g., the plain bearing half liners and slide elements) being simultaneously positioned on the collars.

It is suggested that the sheet thickness of the front and rear collars is 1.2 to 2.5 times the sheet thickness of the respective boom profile.

In a variant of the invention, the sheet thickness of the upper flange differs from the sheet thickness of the lower flange.

In one embodiment, the U-shaped cross-section of the lower flange comprises two spaced-apart curved portion's which are interconnected with a straight web arranged thereinbetween. This special profile cross-section of the U-shaped form has turned out to be especially suited, because the structure exhibits a great moment of resistance to bending. According to the invention the transverse forces are also introduced into the curved portions of the profile so that the whole profile is very resistant to bulging due to the effect of the curved portions. The membrane effect is thereby exploited.

Preferably, the length of the straight web in the U-shaped lower flange to the profile width corresponds approximately to a ratio of 1:3. The distance of the straight sides between upper flange and lower flange of a structure must here be regarded as the profile width.

The front bearing assembly should comprise a separate slide element in the area between the lower flanges in the area of each curved portion. The forces are solely transmitted via the curved portions also in the lower flange region of the front bearing. Tolerances in the width of the individual structures can be suitably compensated by the separate divided arrangement of the slide elements. Furthermore, there are no moments in the transition area to the straight side of the upper flange or to the straight web, respectively, since the circumferential tensions are introduced tangentially.

Advantageously, the radial distance between inner and outer structures in the area of the round liners] curved portions of the U-shaped lower flange can be greater than the distance between the straight portions of the lower flange.

In a preferred embodiment, the center point of the outer and the center point of the inner curved portion of the inner structure's lower flange are spaced apart from each other, with the center point of the outer center portion being arranged closer to the outer curved portion than the center point of the inner curved portion.

The ratio of profile width to profile height is about 1:1.15 to 1:1.4.

The ratio of the length of the straight side between a rounded edge] corner portion of the upper flange and the subsequent curved portion of the lower flange to the profile height may specifically be 1:1.6 to 1:2.

BRIEF DESCRIPTION OF THE DRAWINGS

The invention shall now be explained in more detail with reference to embodiments and to the drawing, in which.

DETAILED DESCRIPTION OF THE INVENTION

Figure 1:
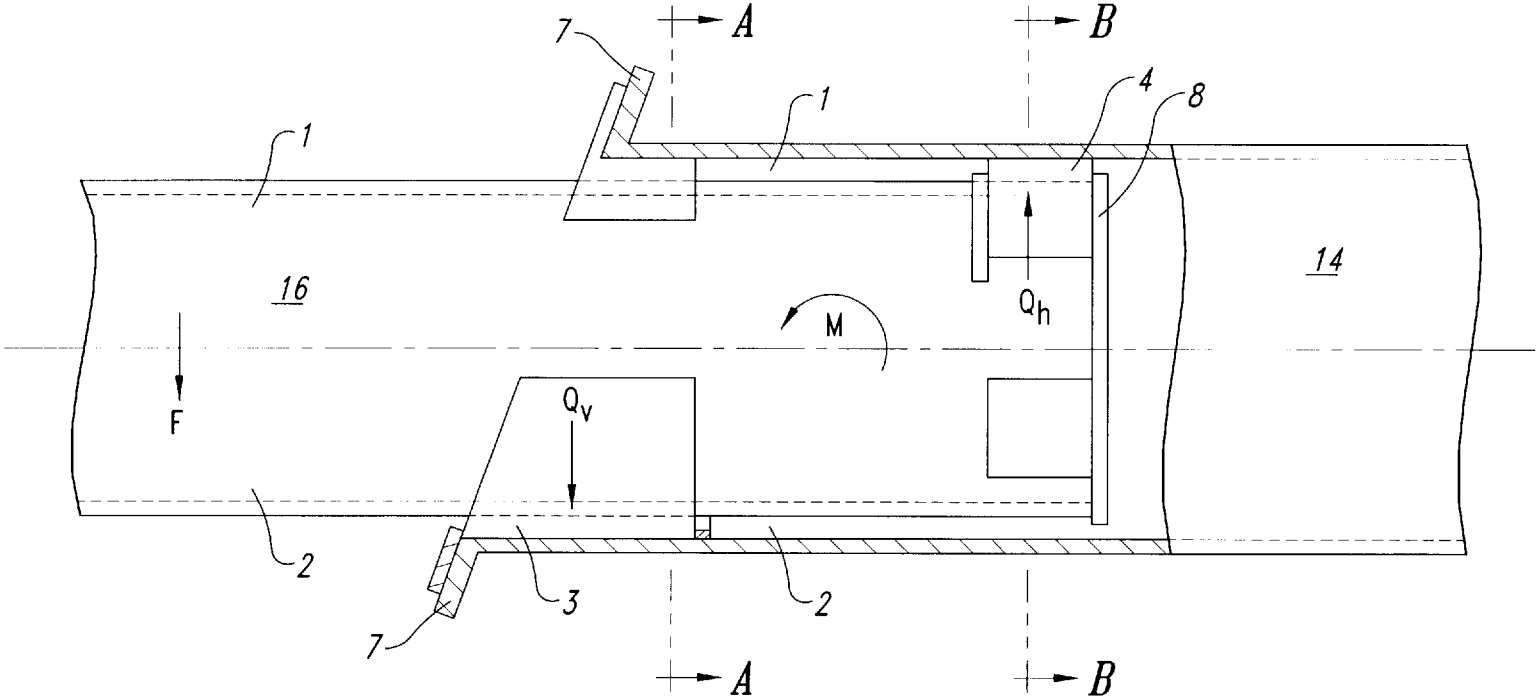
FIG. 1 is a simplified, partly sectional representation of part of an outer structure in which an inner structure is received in part.
Figure 2:
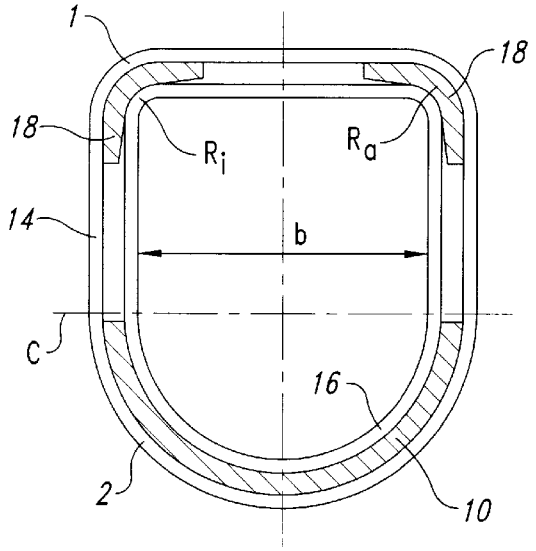
FIG. 2 is a cross section taken along line A—A in FIG. 1.
Figure 3:
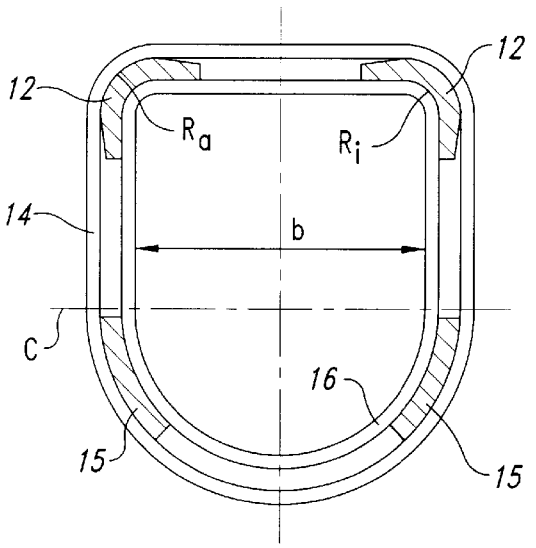
FIG. 3 is a cross section taken along line B—B in FIG. 1.

An outer structure 14 and an inner structure 16 are shown in each of FIGS. 1 to 3. The inner structure 16 is positioned in the interior of a front section of the outer structure 14 over part of the inner structure's length. Each of the outer and inner structures 14 and 16 consists of two bent sheet-metal portions or half liners which are interconnected by longitudinal welds. The outer and inner structures 14 and 16 each include an upper flange 1 having a U-shaped cross-section with rounded corner portions R in the form of quarter circles. In FIGS. 2 and 3, the two rounded corner portions R of the inner structure 16 are designated by Ri, and the two rounded corner portions of the outer structure 14 are designated by Ra. The rounded corner portions extend over 60° to 90°.

The outer and inner structures 14 and 16 each also have a lower flange 2 connected to the respective upper flange 1. Each lower flange 2 has a semicircular shape with a radius equal to half the width (b) of the associated upper flange 1. The radius of the lower flange 2 of the inner structure 16 is correspondingly smaller than the radius of the lower flange of the outer structure 16. Upper and lower flanges 1 and 2 may have different sheet thicknesses.

The upper and lower flanges 1 and 2, which are welded together, have a front collar 7 at their respective front ends at the longitudinal side and a rear collar 8 at their respective rear ends in the form of sheets welded thereonto. These collars are made corrosion-proof and serve as bearings. Each lower flange 2 has assigned thereto a lower slide member, referred to as a slide element 10, of a front bearing assembly 3, and each upper flange 1 has assigned thereto upper slide members, referred to as "rear plain bearing half liners" 12 of a rear bearing assembly 4.

The two collars 7 and 8 simultaneously form a stop for the slide element 10 and rear plain bearing half liners 12 each of which is made of a plastic material, and which are provided at least in the area of the bearings between inner structure 16 and outer structure 14. A slide element 10 made of a plastic material, preferably polyamide, has a shape that corresponds to the semicircular interspace between the lower flange 2 of the inner structure 16 and the lower flange of the outer structure 14, and the slide element is provided in the area of each front bearing assembly 3 assigned to the lower flange 2. Furthermore, in the area of each rear bearing assembly 4 attached to the upper flange 1, supporting rear plain bearing half liners 12 are provided at least in the two interspaces between the inner structure's upper flange and outer structure's upper flange 1 in the area of the two rounded corner portions Ri and Ra, as illustrated in FIG. 3. The semicircular slide element 10 advantageously extends upwards up to the horizontal line designated by C in FIGS. 2 and 3.

The rear plain bearing half liners 12 are each fixed to the outer structure 14 and the slide element 10 is fixed to the inner structure 16.

Cooperation of the two bearings 3 and 4 permits a transmission of transverse forces and bending moments from an inner structure 16 to the adjoining outer structure 14.

If, as illustrated in FIG. 1, a force F acts on the inner structure 16, the force causes a moment M which, in turn, creates transverse forces Qv and Qh. The transverse force Qv deforms the lower flange 2 of the inner structure 16 into an oval form. The transverse force Qv is introduced via slide element 10 into the outer structure 14, whereupon the cross section thereof is equally deformed into an oval form. In particular, the cross section becomes longer in the vertical direction and shorter in the horizontal direction. It is this shortening in the transverse direction that effects an advantageous stabilization of bearing 3 by way of a Fassdauge effect as a consequence of the pressure exerted on the inner structure 16. Furthermore, bulging is prevented by the large-surface contact imparted by the slide element 10. Furthermore, undesirable bulging is prevented by the transverse force Qv acting on the lower flange 2 of semicircular shape, so that the membrane effect of a portion can be exploited. As a consequence, the sheet thickness of the lower flange may be small, which reduces the dead weight of the structure.

The rear bearing force Qh stresses the inner surface of the outer structure 14 in the area of the rear bearing 4. As shown in FIG. 3, the two inner rounded corner portions Ri of the inner structure 16 are connected in the area of the rear bearing 4 with the aid of the two rear plain bearing half liners 12 to the two outer rounded corner portions Ra of the outer structure. As for this rear bearing assembly 4, it should be noted that the rear plain bearing half liners 12 are not supported on a separate collar, as in the prior art, but are supported by the arched sheet of the inner structure 16. At the same time, the disc effect of the upper flange 1 is exploited upon introduction of a load. This, in turn, has the effect that in the telescopic boom of the invention the width of the rear plain bearing half liners 12 and of the slide element 10 (i.e., its dimension in the longitudinal direction of the boom) depends on the width of the associated collar 8. As already mentioned, such a construction leads again to an increase in the usable boom length.

The sheet thickness of the front collar 7 and the sheet thickness of the rear collar 8 are preferably 1.2 to 2.5 times the sheet thickness of the sheet used for the respective boom profile (e.g., the upper and lower flanges 1 and 2).

The front bearing assembly 3 also has upper slide members referred to as "front plain bearing half liners" 18. The front plain bearing half liners 18 are made of plastic material, as shown in FIG. 2. The front plain bearing half liners 18 are assigned to the front collar 7 in the interspaces between the outer rounded corner portions Ra and the inner rounded corner portions Ri. Instead of the two front plain bearing half liners 18 shown in FIG. 2, in an alternate embodiment there may only be provided a single slide member. The front plain bearing half liners 18 must be designed and arranged such that the inner structure 16 is prevented from tilting inside the outer structure 14.

The front plain bearing half liner 18 is not permanently acted upon with forces.

As illustrated in FIG. 3, the rear bearing assembly 4 also has lower slide members referred to as sliding block elements 15. The sliding block elements 15 are made of plastic material and may be provided in the area of the rear collar 8, namely in the area of the lower flange 2 thereof. These sliding block elements 15 are arranged between the semicircular lower flange 2 of the inner structure 16 and the semicircular lower flange of the outer structure 14. The sliding block elements 15 advantageously extend with their upper ends up to the horizontal line C. Instead of the bipartite configuration of the sliding block elements 15 as shown in FIG. 3, the sliding block elements 15 in an alternate embodiment may be of a one-part configuration. As a rule, sliding block elements 15 must be designed and arranged such that the inner structure 16 does not tilt into the interior of the outer structure 14, since the sliding block elements are specifically stressed upon the action of a lateral force or a transverse force component on the inner structure.

The above-discussed front plain bearing half liners 18 (FIG. 2) connected to the outer structure 14 at the forward end are only loaded in the maximally extended state, i.e., only at a minimum clamping length of the inner structure 16 to support the inner structure against lateral escape (tilting).

Figure 4:
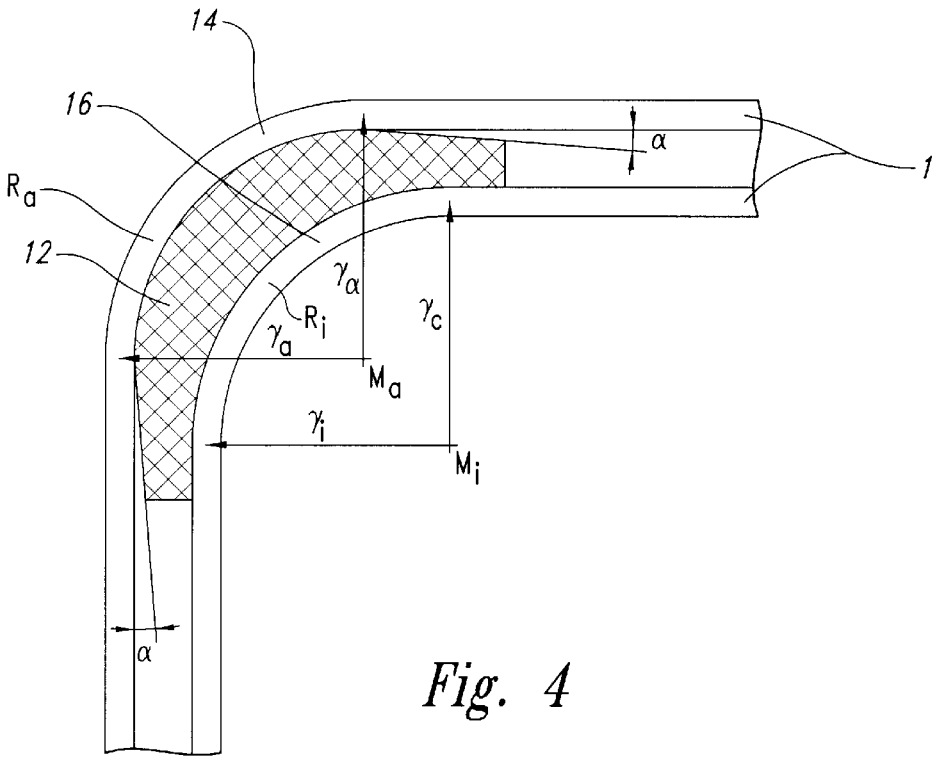
FIG. 4 is an enlarged partial section taken along line B—B in FIG. 1 with a slide element in the rounded corner portion.

FIG. 4 illustrates a front plain bearing half liner 12 between two rounded corner portions Ri, Ra of the upper flanges 1 at the rear end of the inner structure 16. In the area of the rounded corner portions Ri, Ra, the distance between the two upper flanges 1 of the inner and outer structures 16 and 14 is greater than in the straight web and side portions of the upper flanges. The rounded corner portions Ri, Ra have center points Ma, Mi which are spaced apart, with the center point Ma of the rounded edge Ra being arranged closer to the plain bearing half liner 12 and the rounded edges Ri, Ra, respectively. In the figure, the center point Ma is represented by two drawn radii ra each, and center point Mi is represented by two radii ri in analogy therewith.

The front plain bearing half liner 12 is fixed to the inner structure 16, so that it performs a relative movement relative to the rounded corner portion Ra of the outer structure 14. The front plain bearing half liner 12 extends partially into the straight portions adjoining the rounded corner portions Ri, Ra, and engages the inner structure 16 in the straight portion. With respect to the outer structure 14, the front plain bearing half liner 12 recedes, starting from the transitions to the straight portions, at an angle $\alpha$ from the outer structure 14. Hence, the front plain bearing half liner 12 only engages the outer structure 14 in the area of the rounded corner portion Ra. By analogy with FIG. 4, the front plain bearing half liners 18 at the front end of the outer structure 14 are similarly formed and fixed to the outer structure. The front plain bearing half liners 18 also rest in the straight portions adjoining the rounded corner portions Ri, Ra on the outer structure 14 and recede in the straight portions of the inner structure 16 at an angle $\alpha$ from the upper flange 1 thereof.

Figure 5:
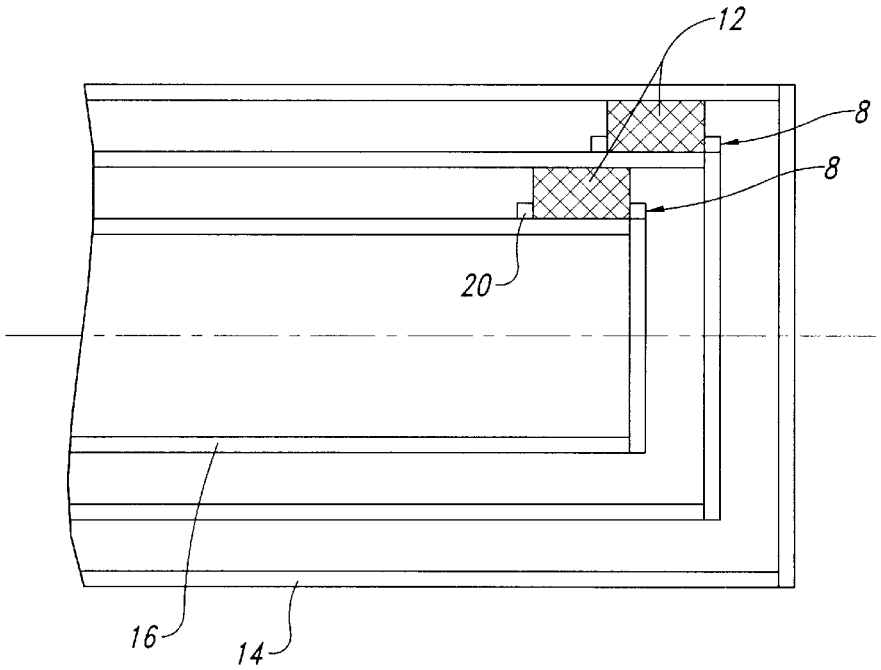
FIG. 5 is a simplified sectional view of the rear end of three telescoped structures of a boom of the invention.

FIG. 5 illustrates a telescoped boom with three structures. In vertical section, a sectional view of the rear plain bearing half liners 12 is shown. The rear plain bearing half liners 12 rest with one side on the small rear collar 8 and are bordered at the other side by an edge 20. The edge 20 is circumferentially limited to the portion of the rear plain bearing half liners 12. In the illustrated telescoped state, the rear plain bearing half liners 12 of the adjoining structures partly overlap and can thus be slid into one another to a very great extent.

Figure 6:
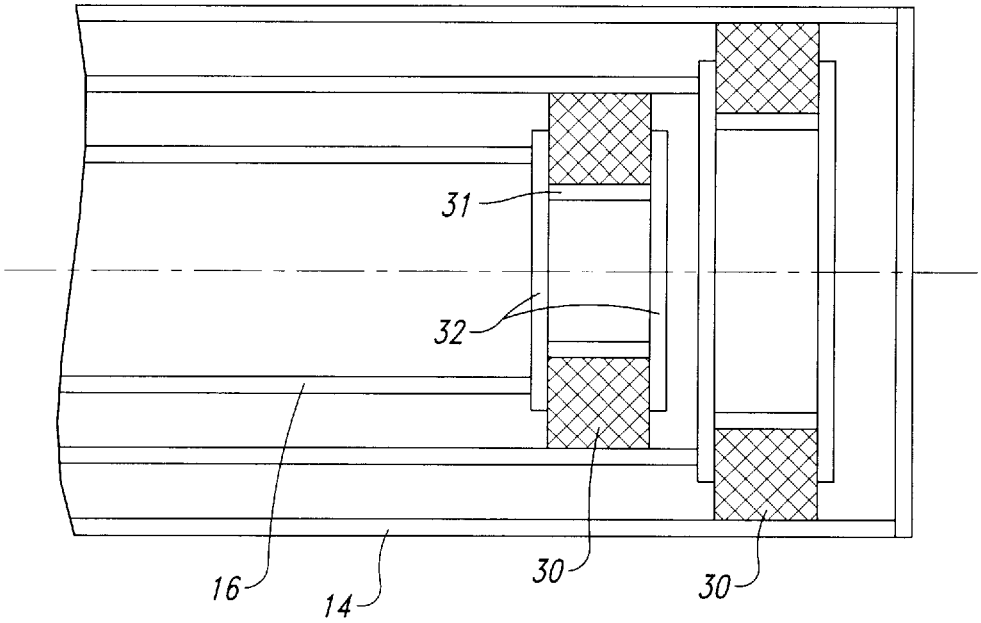
Fig. 6 (PRIOR ART)
FIG. 6 is a simplified sectional view of three telescoped structures with a broad rear collar of a boom according to the prior art.

FIG. 6 illustrates three structures in the retracted state according to a bearing arrangement of the prior art. The structures are here supported within one another by a round surrounding, with the bearing elements 30 being each received in a half-basket bearing block 31 which is offset relative to the associated structure towards the inside. The border of the bearing block 31 is respectively formed by two collars 32 which are continuous across the cross-section of the structure.

As shown in FIG. 6, which shows the prior art, the continuous collars 32 which are required for stability reasons prevent further insertion of the inner structures 16, so that the rear ends of the structures 16 must be arranged side by side. Moreover, as shown in the drawing, the bearing elements 30 are substantially thicker in the radial direction than the slide elements 12 according to the invention (FIG. 5).

Figure 7:
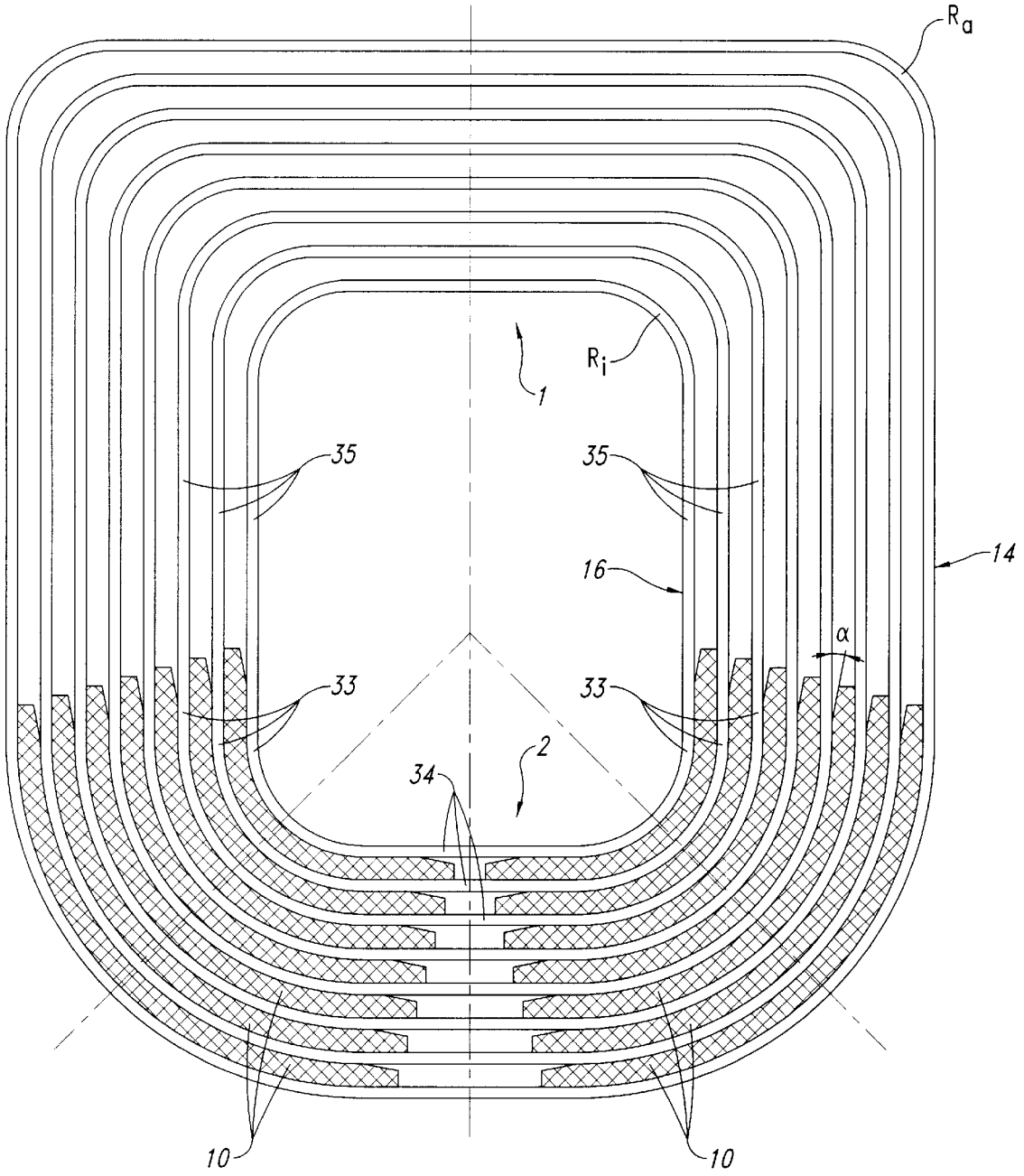
FIG. 7 is a cross section through the front bearing of a boom of the invention with eight structures whose lower flanges have two spaced-apart curved portions.

In FIG. 7, a telescopic boom according to the invention is shown with eight structures in which the U-shaped portion of each lower flange 2 is formed from two spaced-apart round portion 33 shaped as quarter circles. A straight web portion 34 which extends in parallel with the straight portion of the upper flange 1 between the rounded corner portions Ri, Ra is arranged between the rounded portions 33.

A slide element 10 which is substantially shaped as a quarter circle is respectively arranged between the round portion 33 of two adjacent structures. The slide element 10 is adapted to the respective shape of the round portion 33. The slide elements 10 are each fixed to their outer structure 14 and extend at this side portionwise into the straight web portion 34 and into the straight side 35, respectively, between lower flange 2 and upper flange 1. At the side of the inner structure 16, the slide elements 10 rest only in the curved portion of the round portion 33. In the straight portion, the slide elements 10 are formed by analogy with the ends of the plain bearing half liners 12 illustrated in FIG. 4. Starting from the rounded portion 33, the slide elements 10 recede at the side of the inner structure 16 in an oblique taper zone at an angle α from the inner structure.

Of course, the rear bearing assembly 4 may also be formed in the lower flange portion 2, as illustrated in FIG. 7. In this case, the sliding block elements 15 are formed at the round portions 33.

In the cross-section illustrated in FIG. 7, in the upper flange portion 1, the same arrangement of the front plain bearing half liners 18 can be chosen in the area of the rounded corner portions ri, ra as in the embodiments illustrated in the remaining figures.

I claim:

1. A telescopic boom comprising a substantially hollow outer structure and an inner structure telescopically disposed within the outer structure, each of the inner and outer structures having interconnected upper and lower portions formed from bent sheet metal, the upper portion having a cross-sectional area defined by a first and second round corner portions spaced apart from each other, a web portion extending between the first and second round corner portions, and first and second side portions extending away from the first and second round corner portions, respectively, and being connected to the lower portion, each lower portion having third and fourth side portions interconnected by a curved portion and connected to the first and second side portions, respectively, of the upper portion, the inner structure being slidably connected to the outer structure by front and rear bearing assemblies positioned between the inner and outer structures, the front bearing assembly having a first lower slide member connected to the outer structure's lower portion and slidably engaging the inner structure's lower portion only along the curved portion, the rear bearing assembly having first upper slide members positioned between the upper portions of the inner and outer structures, the first upper slide members being connected to the upper portion of the inner structure and slidably engaging the upper portion of the outer structure only along the first and second round corner portions.

2. The telescopic boom of claim 1 wherein the rear bearing assembly includes a second lower slide member positioned between the lower portions of the inner and outer structures and slidably engaging the curved portion of one of the lowered portions of the inner and outer structures.

3. The telescopic boom of claim 2 wherein the rear bearing assembly includes a third lower slide member positioned between the lower portions of the inner and outer structures and slidably engaging the curved portion of one of the lowered portions of the inner and outer structures.

4. The telescopic boom of claim 2 wherein the second lower slide member is fixedly attached to the lower portion of the inner structure.

5. The telescopic boom of claim 2 wherein the first upper slide members and the second lower slide member are fixedly attached to the inner structure.

6. The telescopic boom of claim 1 wherein the first lower slide member is fixedly attached to the lower portion of the inner structure.

7. The telescopic boom of claim 1 wherein the front bearing assembly includes second upper slide members slidably engaging one of the upper portions of the inner and outer structures only along the first and second round corner portions.

8. The telescopic boom of claim 7 wherein the first lower slide member and the second upper slide members are fixedly attached to the outer structure.

9. The telescopic boom of claim 1 wherein a radial distance between adjacent first round corner portions of the upper portions of the inner and outer structures is greater than a distance between adjacent web portions of the upper portions of the inner and outer structures.

10. The telescopic boom of claim 1 wherein a first center point of the first round corner portion of the outer structure's upper portion and a second center point of the first round corner portion of the inner structure's upper portion are spaced apart from each other, the first center point being arranged closer to the first round corner portions of the upper portions of the inner and outer structures than the second center point.

11. The telescopic boom of claim 1 wherein the first lower slide member has an engagement surface and a sliding surface, the engagement surface being adjacent to the outer structure's lower portion along the curved portion and at least one of the third and fourth side portions, and the sliding surface slidably engages the inner structure's lower portion only along the curved portion and being out of direct engagement with the third and fourth side portions of the inner structure's lower portion.

12. The telescopic boom of claim 11 wherein a portion of the first lower slide members sliding surface includes a surface portion out of engagement with the inner structure's lower portion and extending upwardly away from the curved portion of the inner structure's lower portion and being spaced apart from the at least one of the third and fourth side portions of the inner structure's lower portion to define a selected angle relative thereto.

13. The telescopic boom of claim 1 wherein at least one of the first upper slide members has an engagement surface and a sliding surface, the engagement surface being secured to the outer structure's upper portion along the first round corner portion at least a portion of one of the web portion, the side portion, and the second side portion, and the sliding surface slidably engages the inner structure's upper portion only along the first round corner portion and being out of direct engagement with the web portion and the first and second side portions of the inner structure's upper portion.

14. The telescopic boom of claim 13 wherein a portion of the first upper slide member's sliding surface includes a portion out of engagement with the at least one of the web portion, the first side portion, and the second side portion of the inner structure's upper portion and extending away from the first round corner portion of the inner structure's upper portion and being spaced apart from at least one of the web portions, the first side portion and the second side portion of the inner structure's upper portion to define a selected angle relative thereto.

15. The telescopic boom of claim 1 further comprising a front collar connected to the outer structure adjacent to the front bearing assembly and positioned to provide an abutment for the first lower slide member, and further comprising a rear collar connected to the inner structure adjacent to the rear bearing assembly and positioned to provide an abutment for the first upper slide members.

16. The telescopic boom of claim 15 wherein the front and rear collars have a sheet thickness of 1.2 to 2.5 times the sheet thickness of the respective boom profile.

17. The telescopic boom of claim 1 wherein the upper portion of one of the inner and outer structures is made of a sheet material having a first thickness and the lower portion of one of the inner and outer structures is made of a sheet material having a second thickness that is different than the first thickness.

18. The telescopic boom of claim 1 wherein the lower portion of the outer structure has a U-shaped cross-section and the curved portion of the lower portion is defined by first and second spaced apart lower round corner portions interconnected by a lower web portion extending therebetween.

19. The telescopic boom of claim 18 wherein the first lower slide member comprises a first and second lower slide components, the first lower slide component being between the first lower round corner portions of the lower portions of the inner and outer structures, and the second lower slide component being between second lower round corner portions of the inner and outer structures.

20. The telescopic boom of claim 18 wherein a radial distance between adjacent first lower round corner portions of the inner and outer structures in greater than a distance between the lower web portions of the inner and outer structures.

21. The telescopic boom of claim 18 wherein a first center point of the first lower round corner portion of the outer structure's lower portion and a second center point of the first lower round corner portion of the inner structure's lower portion are spaced apart from each other, the first center point being arranged closer to the first lower round corner portion of the lower portions of the inner and outer structures than the second center point.

22. The telescopic boom of claim 18 wherein the first side portion of the upper portion of one of the inner and outer structures and the third side portion of the lower portion of the one of the inner and outer structures define a first length and the one of the inner and outer structures has a cross-sectional height, a ratio of the first length to the cross-sectional height is approximately 1:1.6 to 1:2.

23. The telescopic boom of claim 1 wherein the outer structure has a cross-sectional width and a cross-sectional height, and the ratio of cross-sectional width to cross-sectional height is approximately 1:1.15 to 1:1.4.

* * * * *